United States Patent [19]

Yoshino et al.

[11] Patent Number: 4,910,535

[45] Date of Patent: Mar. 20, 1990

[54] IMAGE FORMING APPARATUS

[75] Inventors: Kunihisa Yoshino; Kimio Nishizawa; Hiroshi Tokunaga; Toshihiro Takesue, all of Hachioji, Japan

[73] Assignee: Konica Corporation, Tokyo, Japan

[21] Appl. No.: 303,645

[22] Filed: Jan. 27, 1989

[30] Foreign Application Priority Data

Jan. 29, 1988 [JP] Japan ..... 63-19206
Jan. 29, 1988 [JP] Japan ..... 63-19207

[51] Int. Cl.[4] ..... G03G 15/01

[52] U.S. Cl. ..... 346/157; 355/246; 355/327

[58] Field of Search ..... 355/246, 251, 259, 326, 355/327, 328; 118/656–658; 346/157, 160

[56] References Cited

U.S. PATENT DOCUMENTS 4,398,817 8/1983 Nishimura ..... 355/326
4,591,261 5/1986 Saruwatari et al. ..... 355/251
4,803,518 2/1989 Haneda et al. ..... 355/327 X
4,816,869 3/1989 Kasai et al. ..... 355/326 X

*Primary Examiner*—R. L. Moses
*Attorney, Agent, or Firm*—Jordan B. Bierman

[57] ABSTRACT

An image forming apparatus wherein a toner image obtained by developing a first electrostatic latent image with a first color dry toner by a first developing device and a toner image obtained by developing a second electrostatic latent image with second color dry toner which is different in color from said first color dry toner by a second developing means are superposed on an image retainer, and wherein toner feeding speeds at which the first and second developing devices develop the first and second electrostatic latent images, resepctively, are different from each other and an attached amount of the second color toner is smaller than that of the first color toner.

11 Claims, 9 Drawing Sheets

FIG. 7

DEVELOPING CONDITION

| ITEM | | CONDITION |
|---|---|---|
| DEVELOPING SLEEVE DIAMETER | | ⌀ 20mm |
| SURFACE ROUGHNESS OF DEVELOPING SLEEVE<br>RZ | | $RZ=1^{+0.5}_{-0}\,\mu m$<br>MEASURED MAGNET ROLLER IN PERIPHERAL DIRECTION<br>SURFACE ROUGHNESS TESTER OF KOSAKA LABORATORY |
| MAGNETIZED PATTERN | | SEE FIG.5 |
| DISTANCE BETWEEN PHOTOSENSITIVE DRUM AND DEVELOPING SLEEVE | | 0.5 mm |
| REVOLUTION NUMBER OF DEVELOPING SLEEVE (rpm) | Y | 260rpm |
| | M | 430rpm |
| | C | 300rpm |
| | BK | 520rpm |
| DEVELOPING ORDER | | Y → M → C → BK |
| AMOUNT OF DEVELOPER ON DEVELOPING SLEEVE | | $8 \pm 0.5\ mg/cm^2$ |
| DEVELOPING BIAS VOLTAGE | | VDC=-700V VAC=700Vrms |
| OTHERS | | SLEEVE IS USED COMMONLY TO EACH DEVELOPING DEVICE |

FIG. 8

| TONER PIGMENT | TITLE | GOODS | MAKER |
|---|---|---|---|
| YELLOW | CI PIGMENT NO YELLOW-17 | KET YELLOW 403 4 PARTS | DAI NIPPON INK CHEMICAL CO., LTD. |
| MAGENTA | CI PIGMENT NO RED-122 | HOSTAPERM PINK E-02 4 PARTS | HOECHST |
| CYAN | CI PIGMENT NO BLUE 15:3 | HELIOGEN BLUE D-7080 2 PARTS | BASF |
| BLACK | MOGUL L. | CARBON BLACK 2 PARTS | CABOT |

FIG. 9A

EXAMPLE 1

| | REVOLUTION NUMBER OF DEVELOPING SLEEVE | ATTACHED TONER AMOUNT ON PHOTOSENSITIVE MEMBER (FIRST LAYER) | ATTACHED TONER AMOUNT ON PHOTOSENSITIVE MEMBER (SECOND LAYER) |
|---|---|---|---|
| Y | 260 rpm | 1.1 mg/cm² | 0.6 mg/cm² (M) |
| | | | 0.6 mg/cm² (C) |
| M | 430 rpm | 1.3 mg/cm² | 0.6 mg/cm² (C) |
| C | 300 rpm | 1.2 mg/cm² | |
| BK | 520 rpm | 1.0 mg/cm² | |

FIG. 9B

EXAMPLE 2

| | REVOLUTION NUMBER OF DEVELOPING SLEEVE | ATTACHED TONER AMOUNT ON PHOTOSENSITIVE MEMBER (FIRST LAYER) | ATTACHED TONER AMOUNT ON PHOTOSENSITIVE MEMBER (SECOND LAYER) |
|---|---|---|---|
| Y | 240 rpm | 1.0 mg/cm² | 0.8 mg/cm² (M) |
| | | | 0.4 mg/cm² (C) |
| M | 450 rpm | 1.5 mg/cm² | 0.4 mg/cm² (C) |
| C | 270 rpm | 1.0 mg/cm² | |
| BK | 550 rpm | 1.2 mg/cm² | |

FIG. 9C

EXAMPLE 3

| FIRST LAYER \ SECOND LAYER | Y | M | C | BK |
|---|---|---|---|---|
| Y | | Y⇒M<br>1.1±0.1mg/cm$^2$<br>(Y)<br>0.6±0.2mg/cm$^2$ | Y⇒C<br>1.1±0.2mg/cm$^2$<br>(Y)<br>0.6±0.3mg/cm$^2$ | |
| M | | | M⇒C<br>1.3±0.2mg/cm$^2$<br>(M)<br>0.6±0.2mg/cm$^2$ | |
| C | | | | |
| BK | | | | |

FIG. 10

COMPARATIVE EXAMPLE

| | REVOLUTION NUMBER OF DEVELOPING SLEEVE | ATTACHED TONER AMOUNT ON PHOTOSENSITIVE MEMBER (FIRST LAYER) | ATTACHED TONER AMOUNT ON PHOTOSENSITIVE MEMBER (SECOND LAYER) |
|---|---|---|---|
| Y | 300 rpm | 1.4 mg/cm$^2$ | 0.2 mg/cm$^2$ (M)<br>0.4 mg/cm$^2$ (C) |
| M | 300 rpm | 0.7 mg/cm$^2$ | 0.9 mg/cm$^2$ (C) |
| C | 300 rpm | 1.2 mg/cm$^2$ | |
| BK | 300 rpm | 0.5 mg/cm$^2$ | |

IMAGE FORMING APPARATUS

BACKGROUND OF THE INVENTION

1. Field of the Invention

The present invention relates to an image forming apparatus having a plurality of developing devices and, more particularly, to an image forming apparatus having improved means for controlling the amount (which will be called the "toner application amount") of toner applied to a latent image on an image retainer from each of the developing devices.

2. Description of the Prior Art

In the image forming apparatus having a plurality of developing devices according to the prior art, the toner application amount is controlled by changing the developing bias voltage of each developing device. Specifically, the developing bias voltage is raised, in case the toner application amount is to be increased, and is dropped in case the toner application amount is to be decreased.

A color image has its color reproduction determined depending upon the toner application amount on a photosensitive member and the developing order. Especially in case a superposition is to be accomplished on the photosensitive member by the reversing development, it is necessary to meet all the various restrictions upon the development such as the image fog, resolution and density. Especially in the two-component development, the condition of carrier application has also to be met.

In case a full-color reproduction is to be accomplished by superposing the toners, moreover, the control of the developing bias for satisfying those restrictions is especially difficult.

The toner application amount control means of the conventional image forming apparatus thus far described is troubled by the following problems. Specifically, if the developing bias voltage exceeds a particular level with a view to increasing the toner application amount, the carrier is caught by the formed image to rough the image surface, or excess toner is applied to the image (to fog the image with the toner) to dirty that portion of the image, which should be intrinsically white or to drop the resolution. Another problem in the full-color image case is to narrow the color reproduction range.

FIG. 4 plots the amount of toner applied to a second layer against that to a first layer. The fourth quadrant plots the potential change against the toner application amount on the first layer when the toner (i.e., the toner on the first layer), which has been subjected to the charging → exposure → development so that it is applied to the photosensitive member, is further subjected to the recharging → reexposure. The potential drop in FIG. 4 indicates the difference between the charging potential and the surface potential at the reexposed portion. The third quadrant plots the potential drop against the developing potential (i.e., the difference between the DC voltage of the developing bias and the surface potential at the reexposed portion). The second quadrant plots the toner application amount on the second layer against the developing potential. This plotted relation presents a characteristic curve for determining the toner application amount on the second layer in case the two toners are superposed on the photosensitive member.

In the case of the full color image, the toner application amount is an important parameter for determining the color reproducing range.

In order to control the toner application amount, it is sufficient to change the characteristic curve of the second quadrant. However, the potential at the reexposed portion, i.e., the parameter for determining the developing potential is determined by the amount of charge of the toner or the like. On the other hand, the DC voltage of the developing bias is also under a substantially determined condition for preventing the toner fog, carrier catch and resolution drop. In order to control the toner application amount under this circumstance, another parameter has to be sought for.

What is required for controlling the toner application amount is the color reproducing range and the monochromatic image density, as shown in FIG. 3. It is therefore preferable to use the image density over a predetermined level. This should take into consideration in the control of the attached toner amount.

SUMMARY OF THE INVENTION

By individually changing the numbers of revolutions of the developing sleeves of developing devices, according to the present invention, a predetermined image density or higher is monochromatically achieved, and the amounts of toners to be applied to the photosensitive member are controlled to stabilize the color reproductions widely, in case the colors are to be reproduced by superposing the toners. Thus, it is possible to provide an image forming apparatus which can control the toner application amounts while being kept away from the carrier catch by the image, toner fog and resolution drop, all of which are liable to occur in case the developing bias voltage is changed.

According to the present invention, there is provided an image forming apparatus which comprises: a plurality of developing devices; drive means for turning the developing sleeves of said developing devices; and revolution control means for controlling the numbers of revolutions of said developing sleeves, respectively, to the predetermined values which are determined according to the developing conditions.

The operations of the image forming apparatus of the present invention having the above-specified means and structure will be described in th following.

The individual developing sleeves in the developing devices are turned by the drive means. The toner application amounts will increase with the increase in the numbers of revolutions of the developing sleeves under a constant developing bias voltage, if the revolution numbers are within a certain range. By changing the respective revolution numbers of the developing sleeves while leaving the developing bias voltages of the developing devices at such constant levels as will cause neither the carrier catch nor the toner fog, therefore, the individual toner application amounts from the developing devices can be controlled. Th revolution control means controls the revolution number of each developing sleeve to that corresponding to the predetermined toner application amount determined according to the individual developing conditions. As a result, each developing device applies the toner in the predetermined amount, which is determined according to its corresponding condition to the latent image of the image retainer.

As has been described above, the image forming apparatus of the present invention is enabled to control the toner application amount to the predetermined amount according to the individual developing conditions by individually controlling the revolution numbers of the respective developing sleeves of the developing devices. As a result, an image of high quality can be formed without any carrier catch by the image, toner fog and resolution drop, all of which are liable to occur in the image forming apparatus of the prior art.

Other objects and features of the present invention will be described in the following with reference to the accompanying drawings.

BRIEF DESCRIPTION OF THE DRAWINGS

FIG. 7 is a table for explaining the developing conditions;

FIG. 8 is a table for explaining toner pigments;

FIGS. 9A to 9C are tables for explaining first to third examples of different developing conditions;

FIG. 10 is a table for explaining a comparison of the developing conditions.

DESCRIPTION OF THE PREFERRED EMBODIMENTS

(EXAMPLE 1)

Figure 1:
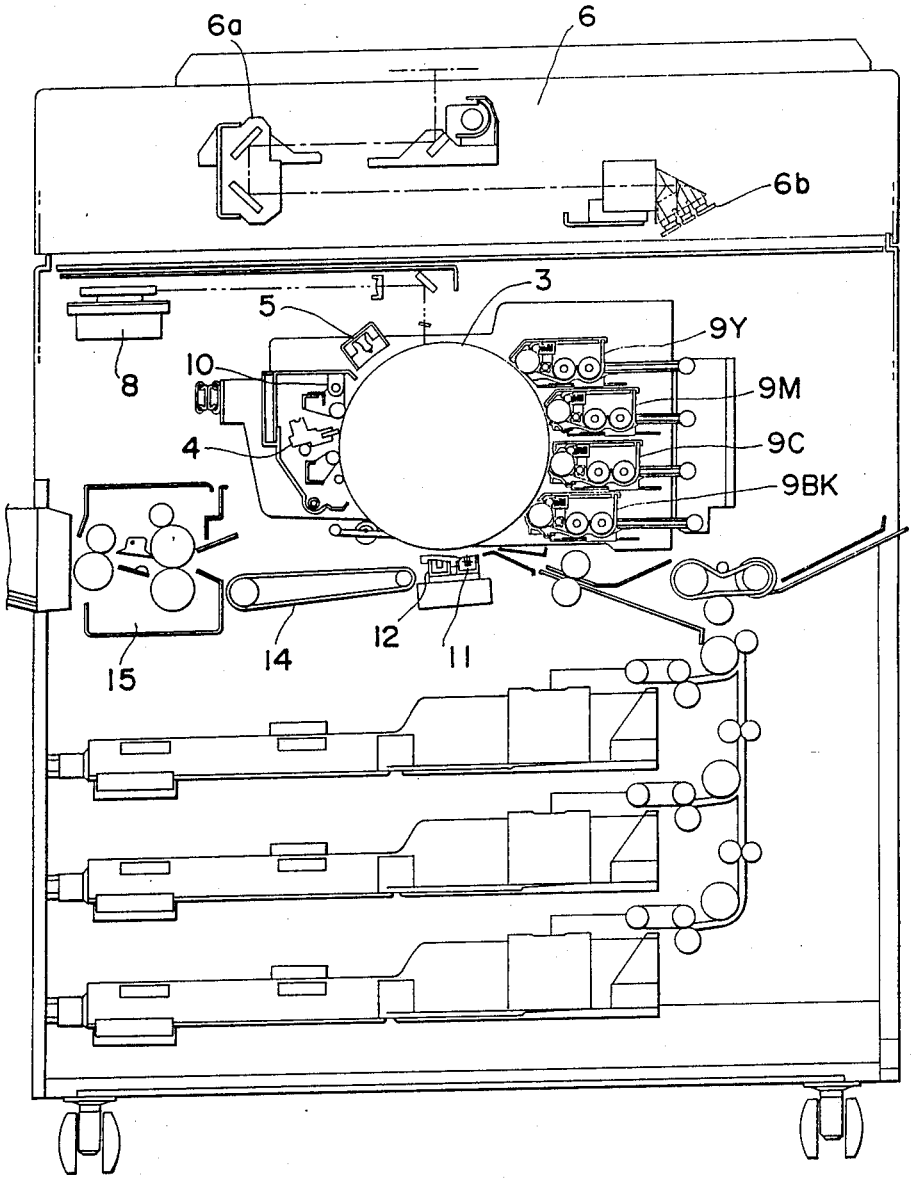
FIG. 1 is a section for explaining the image forming apparatus of the present invention.

When the copy button of the image forming apparatus of FIG. 1 is pushed, a photosensitive drum 3 of phthalocyanine having a diameter of 180 mm is turned in the direction of arrow, and its surface cleaned by a cleaning device 4 is uniformly irradiated by a precharge exposing device 10 using a red LED and is uniformly charged to - 800 V by a charging device 5. In this meanwhile, a document glass plate or document reading means 6 is reciprocated to scan and expose tee document with a document exposing lamp *6a* so that the light reflected from the document surface comes into a color image sensor *6b* through a mirror and a focusing lens. The color image sensor *6b* inputs analog signals which correspond to the images of blue (B), green (G) and red (R) formed by separating the colors of the document image, to an image signal processor (not shown). This image signal processor prepares the digital image signals of the toner colors of Yellow (Y), Magenta (M), Cyan (C) and Black (BK) from the B, G and R signals. In this image forming apparatus, moreover, the Y signal is outputted in the first document scanning and exposure to an image beam scanner 8 so as to effect sufficient color reproduction. The image beam scanner 8 introduces the laser beam, which has been modulated with the Y signal, from a laser light source through beam diameter changing means such as a photo-acoustic element to a deflector such as a rotary polygon mirror so that a laser beam L deflected by the deflector is uniformly introduced into the charged surface of the photosensitive drum 3 through a focusing lens such as an f-$\theta$ lens. As a result, the charged surface of the photosensitive drum 3 is formed with an electrostatic image having a distribution of low potential spots. This electrostatic image is developed to form a Y-toner image by a developing device 9Y using the Y toner as its developer. The surface of the photosensitive drum 3 thus formed with the Y-toner image passes through the positions of developing devices 9M, 9C and 9BK, which have been left inoperative, 2 transfer device 11, a separator 12 and the cleaning device 4 so that it is again uniformly charged by the charging device 5. When this charged surface reaches the incident position of the laser beam L, the image signal processor outputs the M signal, for example, in the second document scanning exposure to the image beam scanner 8 so that the laser beam L modulated with the M signal is emitted from the image beam scanner 8. Combination of charging device 5 and image beam scanner 8 will be called or considered a image forming means in the following. The electrostatic image thus formed is developed into the M-toner image by the developing device 9M using the M-toner as its developer. As a result, the Y- and M-toner images are formed on the photosensitive drum 3. When the surface bearing these Y- and M-toner images reach the position, in which the laser beam L is incident, like before, the image beam scanner 8 then emits the laser beam L which is modulated with the C signal. The electrostatic image thus formed is developed by the developing device 9C using the C toner as its developer. As a result, the photosensitive drum 3 is formed with the color image which is composed of the Y-, M- and C-toner images. When the surface formed with this color image reaches the position, in which the laser beam L is incident, like before, the image beam scanner 8 then emits the laser beam L which is modulated with the BK signal. The electrostatic image thus formed is developed by the developing device 9BK using the K toner as its developer. As a result, the photosensitive drum 3 is formed with a color image which is composed with excellent contrast of the Y-, M-, C- and BK-toner images.

The present invention may be applied to other types of image forming apparatus which having each image forming means like a charging device and image beam scanner corresponding to the plurality of the developing color.

Figure 5:
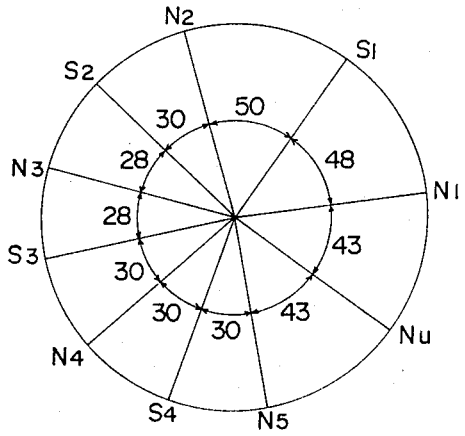
FIG. 5 is a diagram for explaining the magnetic flux density the direction normal to the sleeve surfaces.
Figure 6:
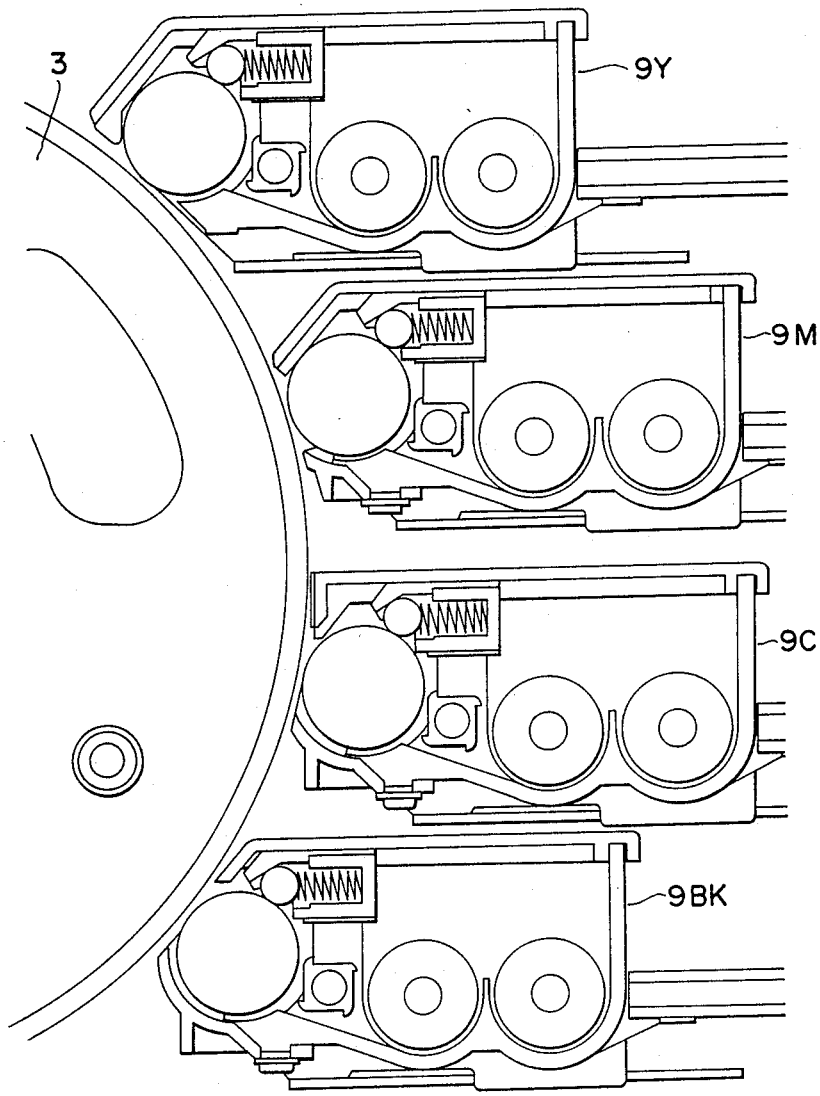
FIG. 6 is a diagram for explaining the developing devices.

Here, the developing devices 9Y, 9M, 9C and 9BK commonly use the developing sleeves which are magnetized in the pattern shown in FIG. 5.

The developments are accomplished in a non-contact manner by depressing a magnetic stainless rod having a diameter 6 mm onto an $S_1$ pole under a load of 1 to 2 gf/mm to form a developer layer having a thickness (or a ear height of 0.3 to 0.4 mm) keeping itself away from contact with the photosensitive drum so that the toners may fly from the developer layer and may be applied to the electrostatic images.

The developing conditions used are exemplified in FIG. 7. The developer used is a two-component developer (having a toner density of 7%, i.e., $Q/M = -10$ to $-15$ $\mu C/g$), which is composed of a coating ferrite carrier having a particle diameter of 40 $\mu m$ and a polyester toner having a particle diameter of 15 $\mu m$. The pigments contained in the individual toners are exemplified in FIG. 8.

If the Y, M, C, BK, Blue, Green and Red solid images are formed, the toners in the amounts exemplified in FIG. 9(A) are applied to the photosensitive member.

The color image thus formed on the photosensitive drum 3 by the steps described above is made so liable by the precharge exposing device 10 as to be transferred and is transferred by the transfer device 11 to a transfer paper P being fed by a paper feeder 14. The transfer paper P having the color image thus transferred thereto is separated from the photosensitive drum 3 by the separator 12 and has its color image fixed by a fixing roller 15 until it is discharged to the outside of the apparatus.

The solid images thus obtained were sufficient for recognizing the Y, M, C, BK, Blue, Green and Red colors.

(EXAMPLE 2)

The solid images of Y, M, C, BK, Blue, Green and Red colors were formed like the Example 1 with the toners applied to the first and second layers of the photosensitive member, by using the numbers of revolutions of the developing sleeves shown in FIG. 9B. The images thus obtained were also sufficient for recognizing the seven colors like the Example 1.

(EXAMPLE 3)

The solid images were formed by changing the numbers of revolutions of the developing sleeves and the amounts of toners applied to the first and second layers of the photosensitive member like the Examples 1 and 2. The seven Y, M, C, BK, Blue, Green and Red colors could be discriminated if the toner application amounts are within the fluctuations, as shown in FIG. 9(C), with respect to those exemplified in Example 1.

(COMPARISON)

The solid images were formed commonly at 300 r.p.m. of the developing sleeves for the Y, M, C and BK colors, as shown n FIG. 10.

In this case, the sleeve r.p.m. stored in the non-volatile memory, as shown in FIG. 1, was 300 r.p.m.

The solid images thus formed had a lower image density and worse Blue and Red color reproductions than those which had the toner application amounts set at predetermined values by controlling the numbers of revolutions of the developing sleeves to those of Example 1.

Figure 2:
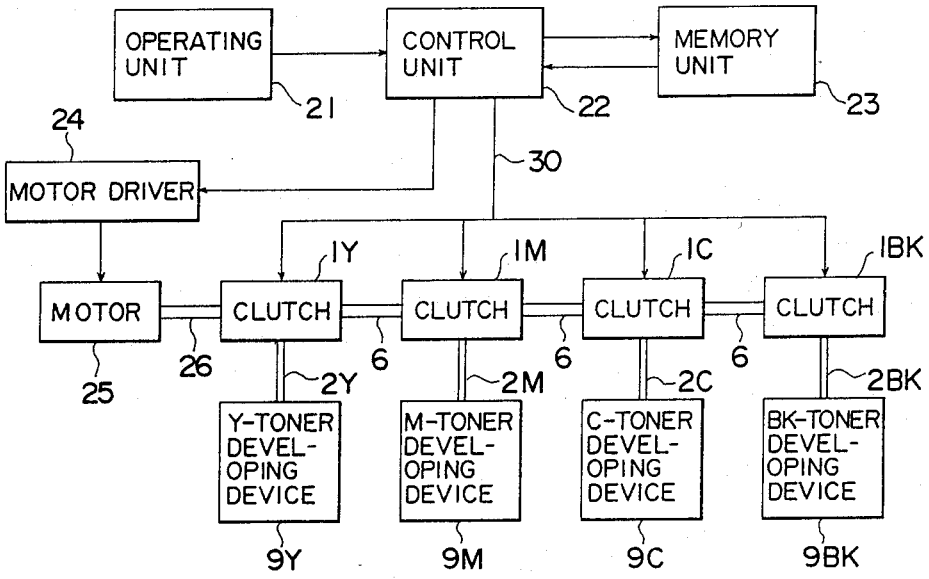
FIG. 2 is a block diagram of the image forming apparatus.
Figure 3:
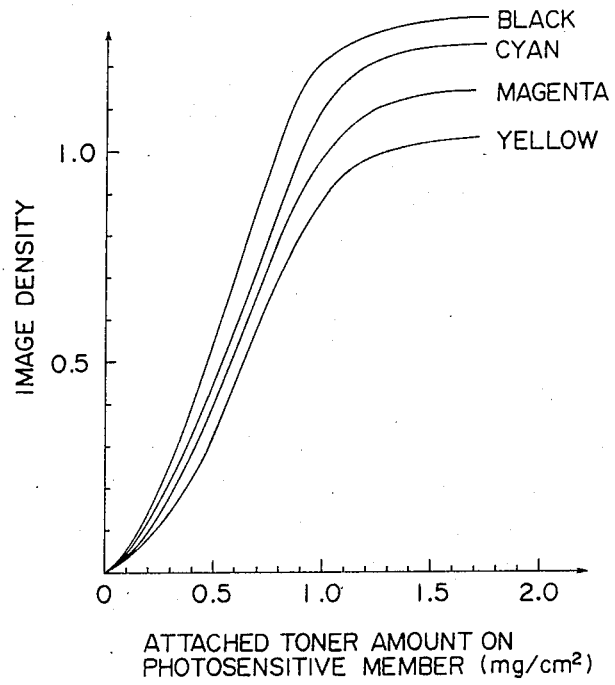
FIG. 3 is a graph for explaining the relations between the image density and the mount of toner applied.
Figure 4:
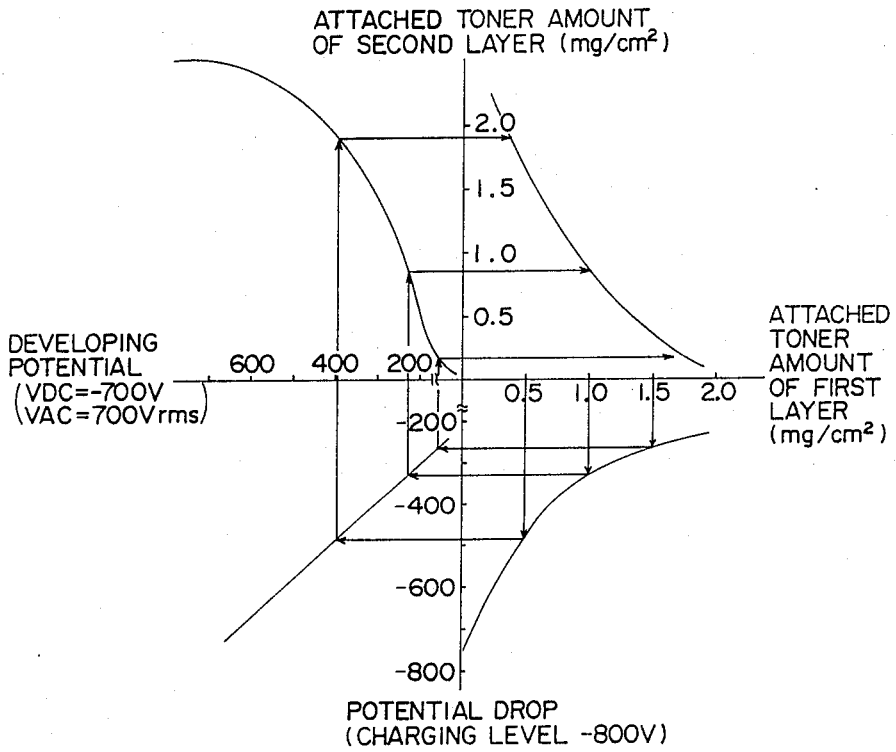
FIG. 4 is a graph for explaining the amounts of individual toners applied to layers.

FIG. 2 is a block diagram showing the structure of the image forming apparatus for accomplishing the experiments of Examples 1, 2 and 3 and Comparison. In FIG. 2, the Y-toner developing device 9Y containing the Yellow toner (which will be shortly referred to as "Y toner"), the M-toner developing device 9M containing the Magenta toner (which will be shortly referred to as "M toner"), the C-toner developing device 9C containing the Cyan toner (which will be shortly referred to as "C toner") and the Black toner developing device 9BK containing the Black toner are equipped with developing-sleeve turning shafts 2Y, 2M, 2C and 2BK, respectively. On the other hand, the rotations of a shaft 26 coupled to a motor 25 are transmitted to the developing-sleeve turning shafts 2Y, 2M, 2C and 2BK by applying clutches 1Y, 1M, 1C and 1BK, respectively. A memory unit 23 is composed of a non-volatile memory, for example, which is stored for the four developing devices, respectively, with the numbers of revolutions of the individual developing sleeves corresponding to the amounts (or densities) of toners applied for effecting the satisfactory developments. The motor 25 starts its rotations in response to the ON signal, which is fed from a control unit 22 to a motor driver 24 before any of the four developing devices comes into its developing operation. The rotations of the motor 25 are interrupted in response to an OFF signal which is fed from the control unit 22 to the motor driver 24 after none of the four developing devices quit their developing operations.

An operation unit 21 is equipped with manual and automatic density setting buttons. If the manual setting button is pushed by the user, the designation of density according to the developing conditions is subsequently accomplished in the operation unit 21 for each of the four developing devices. This density designation information is sent from the operation unit 21 to the control unit 22, which read out the number of revolutions of the developing sleeve of the developing device corresponding to the designated density from the memory unit 23. The control unit 22 feeds not only a clutch actuation signal 30 for applying only the clutch connected to the developing device for the developing operation but also an r.p.m. control signal for turning the developing sleeve of the developing device for that developing operation to the motor driver 24 simultaneously with the clutch actuation signal 30.

As a result, the motor 25 turns only the developing sleeve of the developing device which is connected to the clutch in that applied state, so that the developing device applies the toner in a predetermined amount for the density, which is designated according to the developing conditions by the operation unit 21, to the latent image on the image retainer.

In case the automatic setting button is pushed by the user, patch developments respectively corresponding to the developing devices are accomplished on the image retainer so that the density informations obtained from the results of the developments are fed to the control unit 22. This control unit 22 compares the densities of the patch developments and the set densities, which were preset according to the developing conditions, respectively, for the developing devices.

In case the amounts of toners applied are increased according to the comparison results, an r.p.m. control signal for turning the developing sleeves at predetermined higher values than those at present is fed from the control unit 22 to the motor driver 24. In the contrary case in which the toner application amounts are to be decreased, an r.p.m. control signal for turning the developing sleeves at predetermined lower values than those at present is fed from the control unit 22 to the motor driver 24. These r.p.m. control signals are outputted for each developing device of the developing operation simultaneously with the clutch actuation signal 30 for applying only the clutch connected to said developing device.

As a result, the motor 25 turns only the developing sleeve of the developing device, which is connected to the clutch in said coupled state, at a predetermined r.p.m. outputted from the control unit 22 so that the developing device applies the toner in the predetermined amount, which is set for the density preset according to the developing conditions, to the latent image of the image retainer.

The Examples thus far described are equipped with the clutches 1Y, 1M, 1C and 1BK for turning the developing sleeves of the four developing devices separately with the single motor 25, and there is generated the clutch actuation signal 30 for selectively applying the clutches. However, these clutches and the clutch actuation signal may be dispensed with, if one motor is connected with each of the four developing devices.

Alternatively, a first motor may turn the developing sleeves of the first and second developing devices, and a second motor may turn the developing sleeves of the third and fourth developing devices.

On the other hand, the toner densities of the developing devices are usually detected while the developers are being agitated. These developer agitations are accomplished only while the developing sleeves are being turned, and the numbers of revolutions of the developer agitating shafts correspond to those of the developing sleeves.

If the developing sleeves have different numbers of revolutions, the numbers of revolutions of the developer agitating shafts become different. On the other hand, the sensor (which will be shortly referred to as "L-detection sensor") for detecting the toner densities from the bulk densities of the carriers in the developers is a sensor having its output voltage changing with the agitating states of the developers, i.e., the numbers of revolutions of the developer agitating shafts.

Specifically, the toner densities cannot be detected but during the developing operations, in which the developing sleeves are revolving, and the developer agitating shafts have their numbers of revolutions changing with the different agitating states of the developers, if the developing sleeves have different numbers of revolutions for the individual developing devices. As a result, the output voltage of the L-detection sensor is so changed that the detections are accomplished as if the toner densities were changed. Thus, there arises a problem that the toner densities cannot be accurately detected, if the image forming apparatus is constructed by turning the plural developing sleeves one by one with the single motor and at different r.p.m. according to the developing conditions and if the L-detection sensors used with the developing devices have identical characteristics.

One turning drive source turns the developer agitating shafts and developing sleeves of the plural developing devices. The r.p.m. control mean controls the numbers of revolutions of the developer agitating shafts to a predetermined value between one image forming step and a subsequent image forming step, when in a full-color development, and to the predetermined value, when in a monochromatic development, concurrently with the developing operations. As a result, the toner densities are detected during the full-color development while the developer agitating shafts of all developing devices are turning at the predetermined numbers of revolutions between one image forming step and a subsequent image forming step. During the monochromatic development, on the other hand, the toner densities are detected while the developer agitating shafts are turning at the predetermined numbers of revolutions concurrently with the developing operations. As a result, all the L-detection sensors (which are abbreviated from the sensors for detecting the toner densities by making use of the fact that the inductances are changed according to the percentages of the magnetic materials in the developers) can measure the toner densities in the identical agitating states. It is quite natural that the sensors to be used for detecting the toner densities need not be limited to the L-detection sensors but can be exemplified in the present invention by the sensors to be influenced by the migrations of the developers in the developer baths.

As has been described hereinbefore, the image forming apparatus of the present invention the developer agitating shafts and developing sleeves of the developing devices are concurrently turned during the formation of a monochromatic image at predetermined rates suited for the toner density measurements. During the formation of a full-color image, on the other hand, the developer agitating shafts of all the developing devices are turned at said predetermined rates for a time period between a one-image forming step and a subsequent image forming step, i.e., while none of the developing devices is accomplishing its developing operation. As a result, even if the numbers of revolutions of the developing sleeves are different during the full-color development, all the numbers of revolutions of the developer agitating shafts for the toner density measurements can be equalized so that the toner densities can be accurately measured even if the L-detection sensors to be disposed in the developing devices have the identical characteristics.

Figure 11:
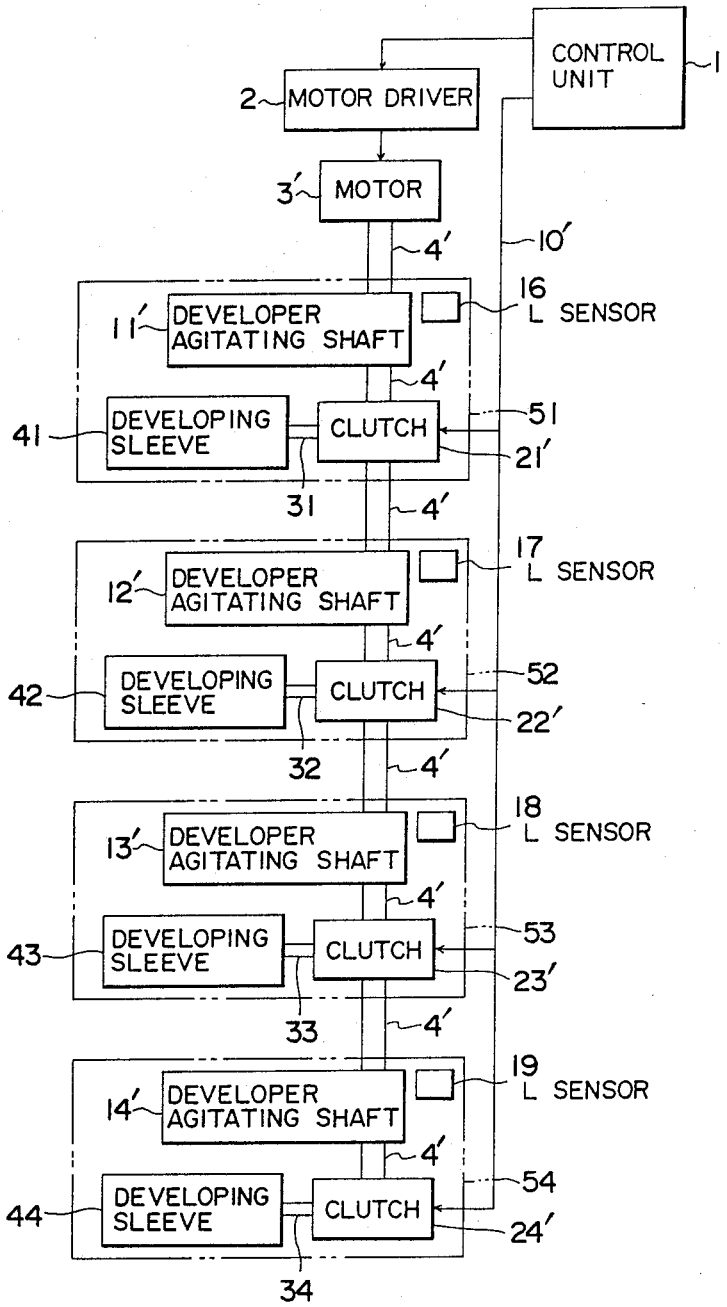
FIG. 11 is a block diagram for explaining another embodiment of the image forming apparatus of the present invention.

FIG. 11 is a block diagram showing the structure of another embodiment of the image forming apparatus of the present invention. In FIG. 11, a Y-toner developing device 51 containing the Yellow toner (which will be shortly referred to as "Y toner"), a C-toner developing device 52 containing the Cyan toner (which will be shortly referred to as "C toner"), a M-toner developing device 53 containing the Magenta toner (which will be shortly referred to as "M toner") and a Black toner developing device 54 containing the Black toner are equipped with the developer agitating shafts 11', 12', 13' and 14', respectively.

These four developer agitating shafts are turned altogether when the shaft 4' is turned by the motor 3'

The Y-toner developing device 51, the C-toner developing device 52, the M-toner developing device 53 and the Black toner developing device 54 are equipped with developing sleeves 41, 42, 43 and 44, respectively. These developing sleeves 41, 42, 43 and 44 are turned one by one when the clutches 21', 22', 23' and 24' are applied one by one to transmit the rotations of the shaft 4' through developing-sleeve turning shafts 31, 32, 33 an 34, respectively.

For the full-color developments, the control unit 1 outputs both the clutch actuation signal 10' for applying only one of the four clutches and the r.p.m. control signal for turning the developing sleeve, to which is transmitted the rotations of the shaft 4' by the applied clutch, to the motor driver 2 simultaneously with the aforementioned clutch actuation signal 10'. As a result, the motor 3' turns only the developing sleeve, to which is transmitted the rotations of the shaft 4' by the applied clutch, at the predetermined r.p.m. While the four developing sleeves are turned one by one at their respective r.p.m., all the developer agitating shafts are turned at the r.p.m. corresponding to those of their respective developing sleeves. In his state, however, L-detection sensors 16, 17, 18 and 19 do not detect the toner densities. For the time period between the one image forming step and the subsequent image forming step, the control unit 1 outputs not only the clutch actuation signal 10' for releasing all the four clutches but also the r.p.m. control signal for turning the developer agitating shafts at the predetermined r.p.m. suited for measuring the toner entities to the motor driver 2. As a result, the motor 3' turns only the four developer agitating shafts at said predetermined r.p.m., and the L-detection sensors 16, 17, 18 and 19 meanwhile detect the toner densities of the individual developing devices.

For the monochromatic developments, the control unit 1 feeds both the clutch actuation signal 10' for applying the clutch corresponding to only the developing sleeve for the developing operations and the r.p.m. control signal for turning the four developer agitating shafts at said predetermined r.p.m. to the motor driver 2 simultaneously with the clutch actuation signal 10'. As a result, the motor 3' turns both the four developer agitating shafts at said predetermined r.p.m. and only the developing sleeve for the developing operations.

The L-detection sensors 16, 17, 18 and 19 detect the toner densities as the developments proceed.

As has been described hereinbefore, according to the image forming apparatus of the present invention, the amounts of toners applied can be controlled to the predetermined values according to the individual developing conditions by separately controlling the number of revolutions of the respective developing sleeves of the developing devices. Thus, the image forming apparatus of the present invention has an advantage that an image of high quality can be formed without any carrier catch by the image liable to be formed by the image forming apparatus of the prior art and the toner fog.

According to the present invention, moreover, the developer agitating shaft and developing sleeve of the developing device for the monochromatic image formation are concurrently turned at the predetermined turning drive rate suited for the toner density measurements. For the full-color image formation, on the other hand, the developer agitating shafts of all the developing devices are turned at said predetermined turning drive rates for the time period between the one image forming step and the subsequent image forming step, i.e., while none of the developing devices are accomplishing the developing operations. As a result, even if the numbers of revolutions of the developing sleeves are different for th full-color developments, all the numbers of revolutions of the developer agitating shafts can be equalized for the toner density measurements. Thus, the image forming apparatus of the present invention has another advantage that the toner densities can be accurately measured eve if the L-detection sensors disposed in the developing devices have the common characteristics.

What is claimed is:

1. An image forming apparatus comprising means for forming a first electrostatic latent image on an image retainer, first developing means for developing said first electrostatic latent image with a first color dry toner to form a toner image on said image retainer, means for forming a second electrostatic latent image on said toner image, second developing means for developing said second electrostatic latent image with second color dry toner which is different in color from said first color dry toner, to form a color image consisting of superposed toners, and control means for controlling so that toner feeding speeds at which said first and second developing means develop said first and second electrostatic latent images, respectively, are different from each other and that an attached amount of said second color toner is smaller than that of said first color toner.

2. The image forming apparatus according to claim 1, wherein means for forming said first and second electrostatic latent images are the same with each other.

3. The image forming apparatus according to claim 1, wherein said second developing means is non-contact developing means.

4. The image forming apparatus according to claim 1, wherein said developing means are applied with AC and DC biases.

5. The image forming apparatus according to claim 1, wherein said first and second developing means are two-component developing means.

6. The image forming apparatus according to claim 1, said first or second color toner is one of Y, M, C and BK toners.

7. The image forming apparatus according to claim 1, wherein said electrostatic latent image forming means charges uniformly and exposes with laser beam the image retainer.

8. The image forming apparatus according to claim 1, wherein the toner feeding speed is controlled by varying the revolution number of a developing sleeve in said developing means.

9. The image forming apparatus comprising means for forming a first electrostatic latent image on an image retainer, first developing means for developing said first electrostatic latent image with a first color dry toner to form a first toner image on said image retainer while said image retainer is rotated, means for forming a second electrostatic latent image on said first toner image, second developing means for developing in non-contact manner said second electrostatic latent image with second color dry toner which is different in color from said first color dry toner, to form a second toner image on said first toner image while said image retainer is rotated, means for forming a third electrostatic latent image on said second toner image, third developing means for developing in non-contact manner said third electrostatic latent image with third color dry toner which is different in color from said first and second color dry toners, to form a third toner image on said second toner image while said image retainer is rotated, means for forming a fourth electrostatic latent image on said third toner image, fourth developing means for developing in non-contact manner said fourth electrostatic latent image with fourth color dry toner which is different in color from said first, second and third color dry toners, to form a color image consisting of superposed toners while said image retainer is rotated, and control means for controlling so that toner feeding speeds $V_Y$, $V_C$, $V_M$, $V_{BK}$ at which said first to fourth developing means develop said first to fourth electrostatic latent images, respectively, are set as $V_{BK}>V_M>V_C>V_Y$.

10. The image forming apparatus according to claim 9, wherein said first to fourth developing means are applied with AC biases.

11. An image forming apparatus comprising means for forming a first electrostatic latent image on an image retainer, first developing means for developing said first electrostatic latent image with a first color dry toner to form a toner image on said image retainer, means for forming a second electrostatic latent image on said toner image, and second developing means for developing said second electrostatic latent image with second color dry toner which is different in color from said first color dry toner, to form a color image consisting of superposed toners, wherein toner feeding speeds at which said first and second developing means develop said first and second electrostatic latent images, respectively, are different from each other and wherein said toner feeding speeds are set similar to each other when the toner density in each of said first and second developing means is detected.

* * * * *